US006439481B2

(12) United States Patent
von Schuckmann

(10) Patent No.: US 6,439,481 B2
(45) **Date of Patent: *Aug. 27, 2002**

(54) SPRAY PUMP CAPABLE OF BEING ACTUATED BY A HAND LEVER

(75) Inventor: Alfred von Schuckmann, Kevelaer (DE)

(73) Assignee: Owens-Illinois Closure Inc., Toledo, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/810,695

(22) Filed: Mar. 14, 2001

Related U.S. Application Data

(63) Continuation of application No. 09/486,887, filed on Mar. 2, 2000, now Pat. No. 6,234,412.

(30) Foreign Application Priority Data

Sep. 4, 1997 (DE) ..... 197 38 777
Jun. 18, 1998 (DE) ..... 198 27 111

(51) Int. Cl.[7] ..... A62C 11/00

(52) U.S. Cl. ..... 239/333; 239/493; 239/491; 222/321.8; 222/383.1

(58) Field of Search ..... 239/333, 493, 239/491, 331, 329, 463; 222/321.8, 383.1, 381

(56) References Cited

U.S. PATENT DOCUMENTS 3,701,478 A 10/1972 Tada
3,726,442 A 4/1973 Davidson
3,897,006 A 7/1975 Tada
4,072,252 A 2/1978 Steyns et al.
4,273,268 A 6/1981 Wickenberg
4,558,821 A 12/1985 Tada
4,646,969 A 3/1987 Sorm et al.
4,826,052 A 5/1989 Micallef
4,915,263 A * 4/1990 Corba ..... 222/321.8
4,955,511 A 9/1990 Blake
5,507,437 A * 4/1996 Foster et al. ..... 222/383.1
5,603,434 A 2/1997 Schuckmann
5,810,209 A 9/1998 Foster
6,234,412 B1 * 5/2001 von Schuckmann ..... 239/333

FOREIGN PATENT DOCUMENTS

EP 0360949 4/1990
FR 2495022 6/1982

* cited by examiner

*Primary Examiner*—William C. Doerrler
*Assistant Examiner*—Dinh Q. Nguyen

(57) ABSTRACT

The invention relates to a hand lever-operated spray pump (3), particularly for attaching to bottles (2) or similar, having a pump plunger (6) which moves linear in a pump chamber (7) on the housing side and which is connected with the hand lever (5) at the rear of a mouth piece opening (9) and which returns to its starting position as a result of a spring loading, and proposes, for the purpose of achieving a structurally simple, functionally reliable solution, to allocate two hinge points (I, II) to the hand lever (5) one of which (I) is movable in a linear guide on the housing side and the other (II) is arranged on the housing on the side opposite to the mouthpiece (9). In such a way that both hinge points (I, II) are connected by means of two buckling bridge sections (a, b).

3 Claims, 5 Drawing Sheets

Figure 3:
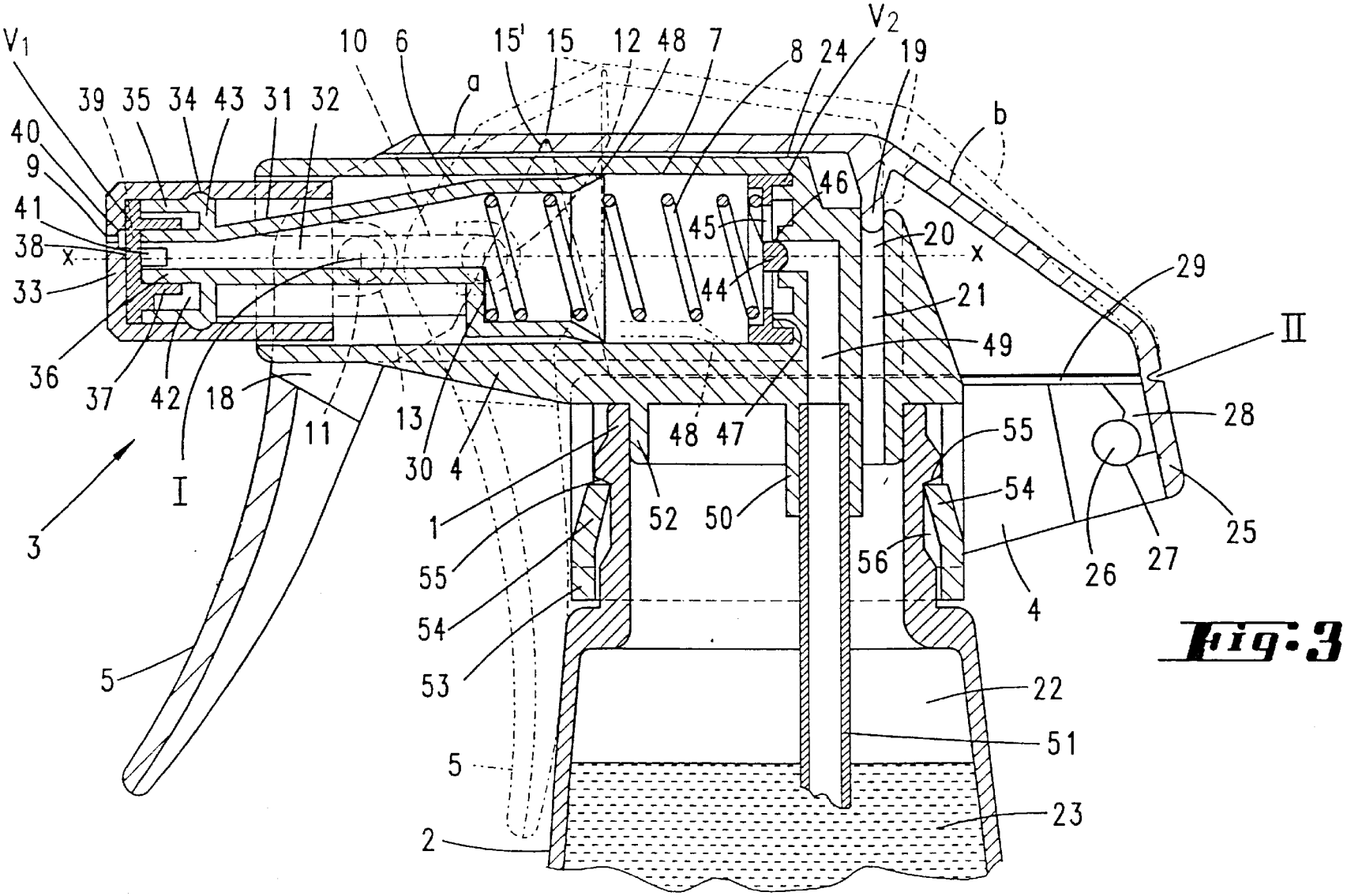

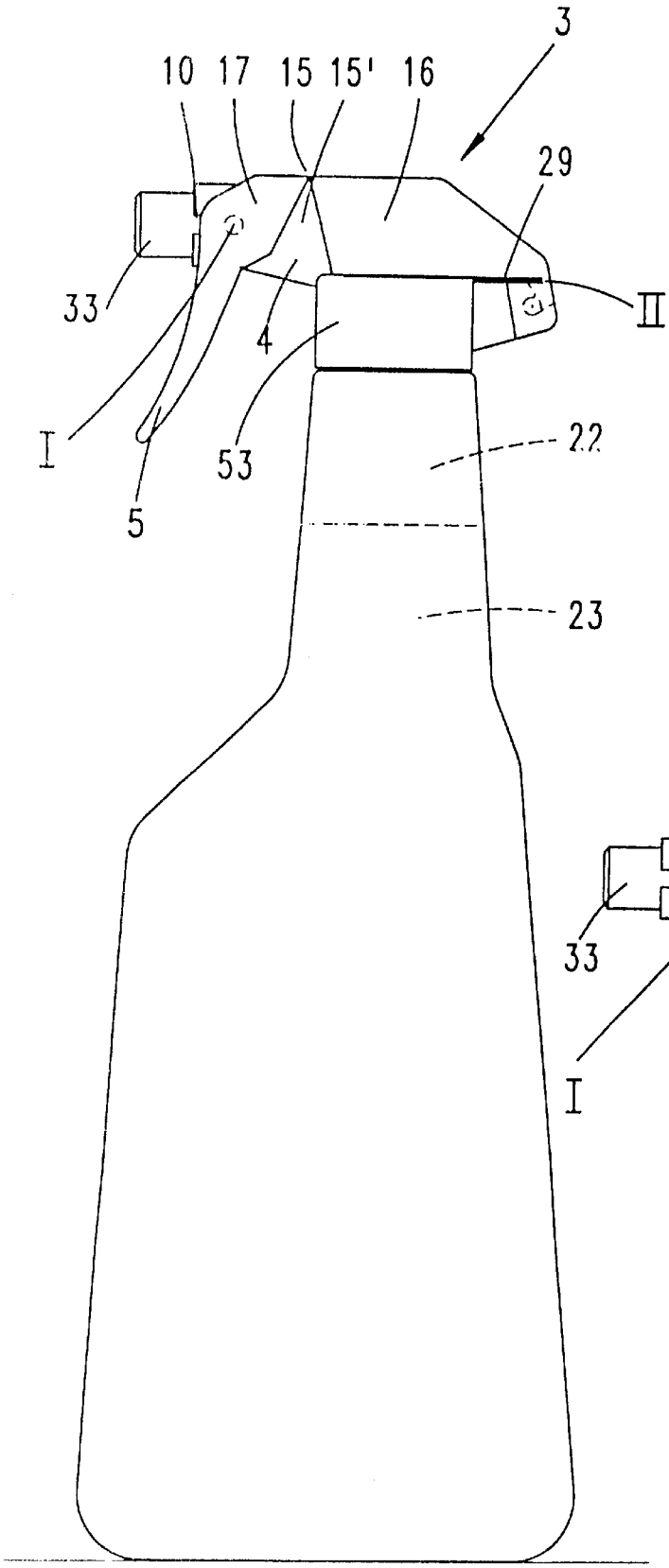
Fig. 1
Fig. 2
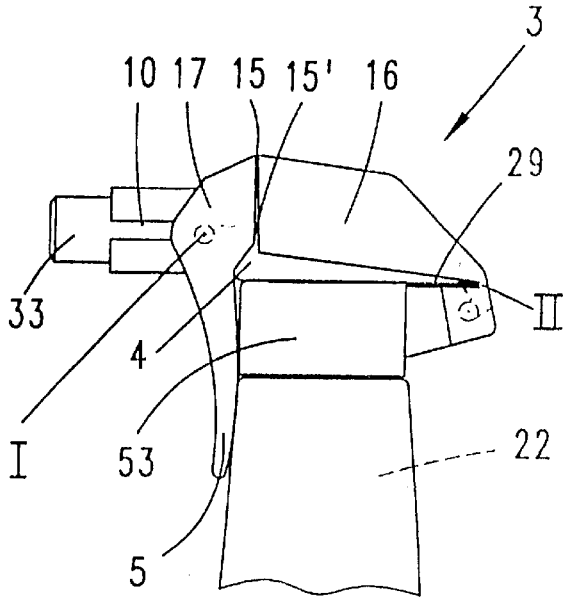

V1
V2
69
70
71
72
75
66
74
45
44
77
81
79
78
80
54
22
51
23
55
56
47
49
50
48
63
65
64
60
61
52
30
62
11
12
15
15'
6
7
8
46
b
a
32
31
67
68
9
33
73
76
18
4
1
5
2
3
I
II
x

SPRAY PUMP CAPABLE OF BEING ACTUATED BY A HAND LEVER

CROSS REFERENCE TO RELATED APPLICATION

This application is a continuation of application Ser. No. 09/486,887 filed Mar. 2, 2000 now U.S. Pat. No. 6,234,412.

FIELD OF THE INVENTION

This invention relates to a hand lever-operated spray pump, particularly for the purpose of attaching to bottles or similar on the housing side. The pump plunger is connected with the hand lever at the rear of a mouthpiece opening and the pump plunger returns to the starting position as a result of a spring loading.

A spray pump of this type is specified in U.S. Pat. No. 4,955,511, where the hand lever is a trigger lever which is rigidly connected with the pump plunger. This causes a tendency for the pump-plunger chamber unit to tilt.

U.S. Pat. No. 3,726,442 specifies a hand lever-operated spray pump whose hand lever is arranged on a pivoting bearing by means of a fork recess/peg engagement on the housing side. Separated by a space thereto, it acts via a living hinge in side acting upon the pump chamber, which is a bellow-type housing on the side opposite to the mouth place by means of an additional living hinge. A finger on the transmitting piece closes/opens on air compensation opening.

It is the object of the invention to provide a hand lever-operated spray pump of the above type which is functionally reliable and structurally simple.

This problem is solved substantially with a hand lever-operated spray pump having the characteristics of Claim 1, provided that two hinge points are allocated to the hand lever, one of which is moving non-rotating on the housing side in a linear guide provided on the housing side, and the other is attached to the housing on the side opposite to the mouth-piece in such a way that both hinge points are connected via two bridge sections that buckle with respect to each other. This prevents the pump plunger from tilting. The hand later performs an overriding movement: swiveling plus shifting. The respective linear guide is defined by the guide on the bridge sections buckle or fold. This movement can even be utilized as a force for restoring the pump plunger to its starting position by means of a hand lever coupling. The bridge sections' buckling movement may then be utilized for an additional function in that one bridge section supports the sealing part for a ventilation aperture which leaves its sealing position with respect to the ventilation aperture during the buckling process. This solves the problem of air compensation by the easiest possible method. As the buckling process takes place only when the pump is activated, this provides for a space-saving outline in non-operating position, offering both storage and packaging advantages. According to the subject matter of U.S. Pat. No. 3,726,442, the overall size of the spray pump decreases only when it is activated. In addition, the invention proposes to provide a living hinge point between the two bridge sections, thereby eliminating the need for classic axes. The second bridge section is then further developed such that it represents the connector on a U-profiled part that encompasses the housing in a U-shape. This provides a strong coupling for the bridge.

In addition, the design is characterized by a locking connection from the U-profiled part toward the housing in order to prevent that this locking point is required for the purpose-of achieving the required flexibility for the respective bridge section, the hinge point, located on the side of the spray pump opposite to the mouthpiece, is a living hinge adjacent to the place of the locking connection. This also prevents any movements caused by the bridge sections' movement to be transferred to said place. In addition, a proposal is made, which has its own significance, according to which the pump plunger continues tapering approximately up to the mouthpiece where it is in form-fit connection with a mouthpiece cap and that, between the two parts, a discharge valve is provided in the form of a moldable rubber piece. This represents a structural simplification, allows easy assembly and requires fewer parts. The rubber piece is of the type which remains closed until a certain high pressure response threshold is reached at which time it opens abruptly. This results in a powerful spray, especially if the rubber piece is mounted on the front end of the pump plunger and is equipped with a collar which expands as a result of the pressure caused by the fluid, and if it has axial flow-through cross sections in a disk-shaped part. These cross sections are connected with the mouthpiece opening in that the mouthpiece cap is rotated. This should be based on eccentricity in order for the spray pump to be a superior with respect to media losses as well. It is advantageous if the spray pump housing is attached to the bottleneck by means of a plug-in/clip connection substituting the normally used swivel nut. With the attachment of a collar, the plug-in connection is able to simultaneously function as a sealing connection.

In addition, the spray pump as per the invention is characterized by a disk-shaped inlet valve having a valve locking piece which is supported by crosspieces. The pump plunger restoring spring is supported by said crosspieces. The opposite end of the spring moves against a cross section-decreasing shoulder in the interior of the hollow pump plunger which trails on the wall of the pump chamber with the edge of the larger cross section opening. This edge is preferably a sleeve-like lip. It is also advantageous to equip the pump plunger with lateral pockets for the hinge point on the hand lever side. The hand lever axle stubs passing through the linear guide are inserted in the pockets. An advantageous variant of an air compensation system is the utilization of the pump plunger. According to this variant, the housing wall of the pump chamber is provided with a ventilation aperture extending into the interior of the bottle. When the pump is in its starting position, the aperture, which is located directly behind the edge of the pump plunger, is closed by the pump plunger, and opens when the pump plunger is activated. This provides for an additional pump plunger function. It acts as a slide. This does not even require that the plunger casing wall is continuously leading. It suffices to equip the pump plunger with two piston rings which, in the pump plunger starting position, are located on either side of the mouth of the ventilation aperture. This decreases the friction against the pump plunger and favors the desired easy activation of the trigger pump. There is an added advantage in that, as a result of creating the ring space, the pump plunger, positioned in the direction of discharge, acts as a seal with relation to the pump chamber, for example in the event of excess pressure in the bottle which may be generated by heat.

An advantageous further development should be noted with respect to the inlet valve. This development is achieved by a disk-shaped inlet valve body which is symmetrical with relation to the disk center plane. The respective mirror symmetrical from permits the use of either side of the inlet valve body, thereby preventing any assembly mistakes or re-work requiring that a side inverted inlet valve be reversed. Regardless of its allocation, the desired valve function is always reliable. It is also advantageous for the valve locking body of the inlet valve to be barrel-shaped having hemispherical ends on both sides. The valve locking body is located in the center of the disk-shaped inlet valve body. 1 Further more, the discharge valve is also further developed which is characterized in that the discharge valve is covered by the mouthpiece cap and that it is equipped on the fore-part with supply channels leading toward the mouthpiece opening. The supply channels can be closed by rotating the mouthpiece cap. This is achieved in that the discharge valve is a moldable rubber piece which is equipped with a stem. One end of the stem supports a valve disk while the other end is equipped with a cylindrical stopper part having diametrically opposed flattened parts that create channels. Supply channels lead from the front of the flattened parts to a central swirl chamber. Due to its larger mass of material, the stopper part is virtually not moldable so that the channel cross sections remain largely unaffected despite the pressure caused by the media, while the valve disk provides the flexibility and restoring force required for the valve function.

For the purpose of locking, it is advantageous for the swirl chamber to be eccentrical, resulting in a congruent position with the mouthpiece opening, which is also eccentrical, and the ability to leave this position which results in blocking the discharge path. Finally, with respect to the axis of the second bridge section, it is proposed to use a hook for the locking connection on the housing side for the second buckling bridge section. The hook is adjacent to a supporting crosspiece whose front surface forms the hinge point in that it is thrust against a housing console at the rear. It is structurally advantageous for the hook to pass through a hole in the rear housing console, and that the supporting crosspiece, which is located behind the hole and which creates the hinge point and runs substantially parallel with the shaft of the hook, forms the end of the second buckling bridge section. The close proximity between the supporting crosspiece and the hook provides for sufficient play to allow the bridge sections to buckle. Added to that is the flexibility and restoring force of the material used, i.e. synthetic material.

Figure 4:
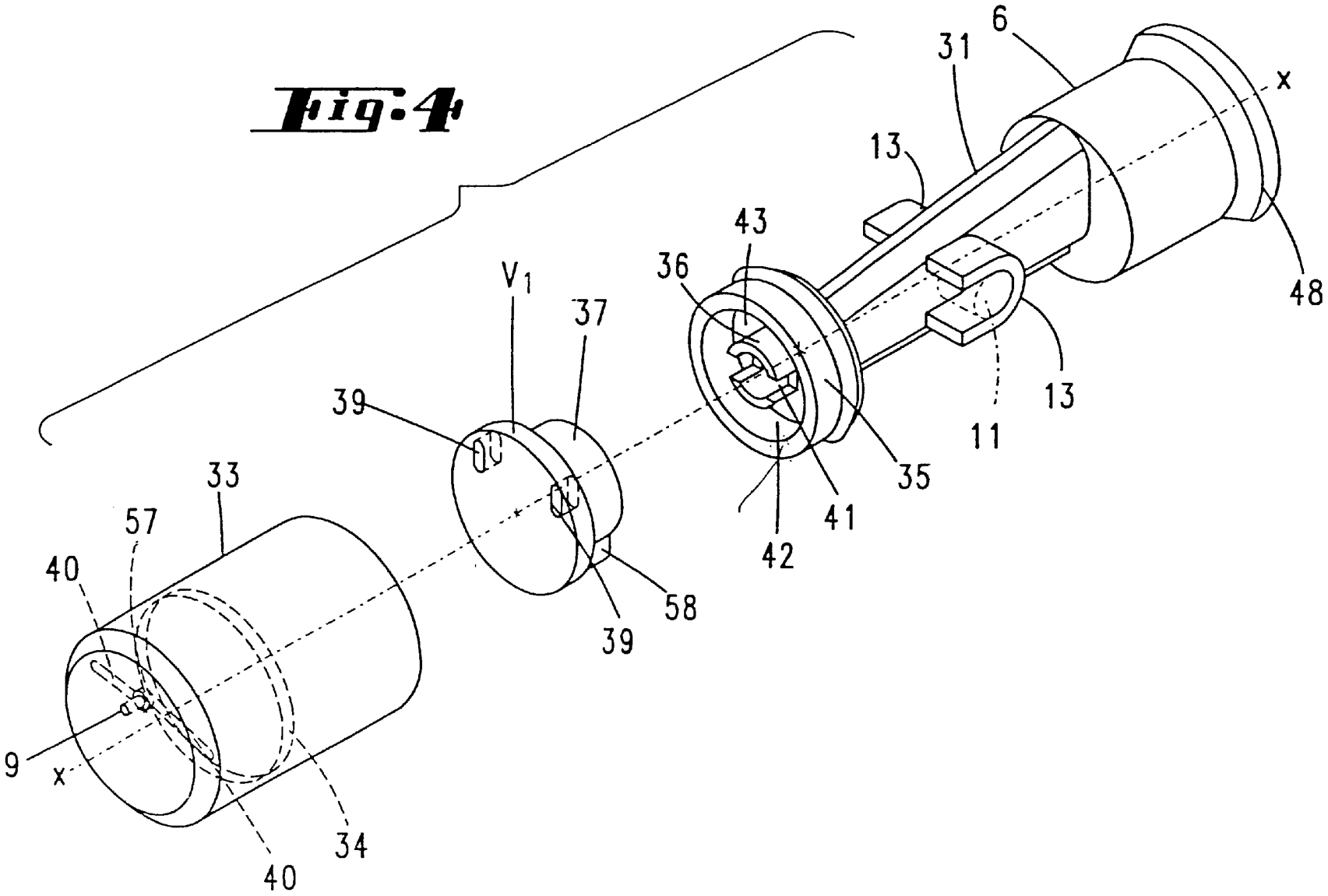
Figure 5:
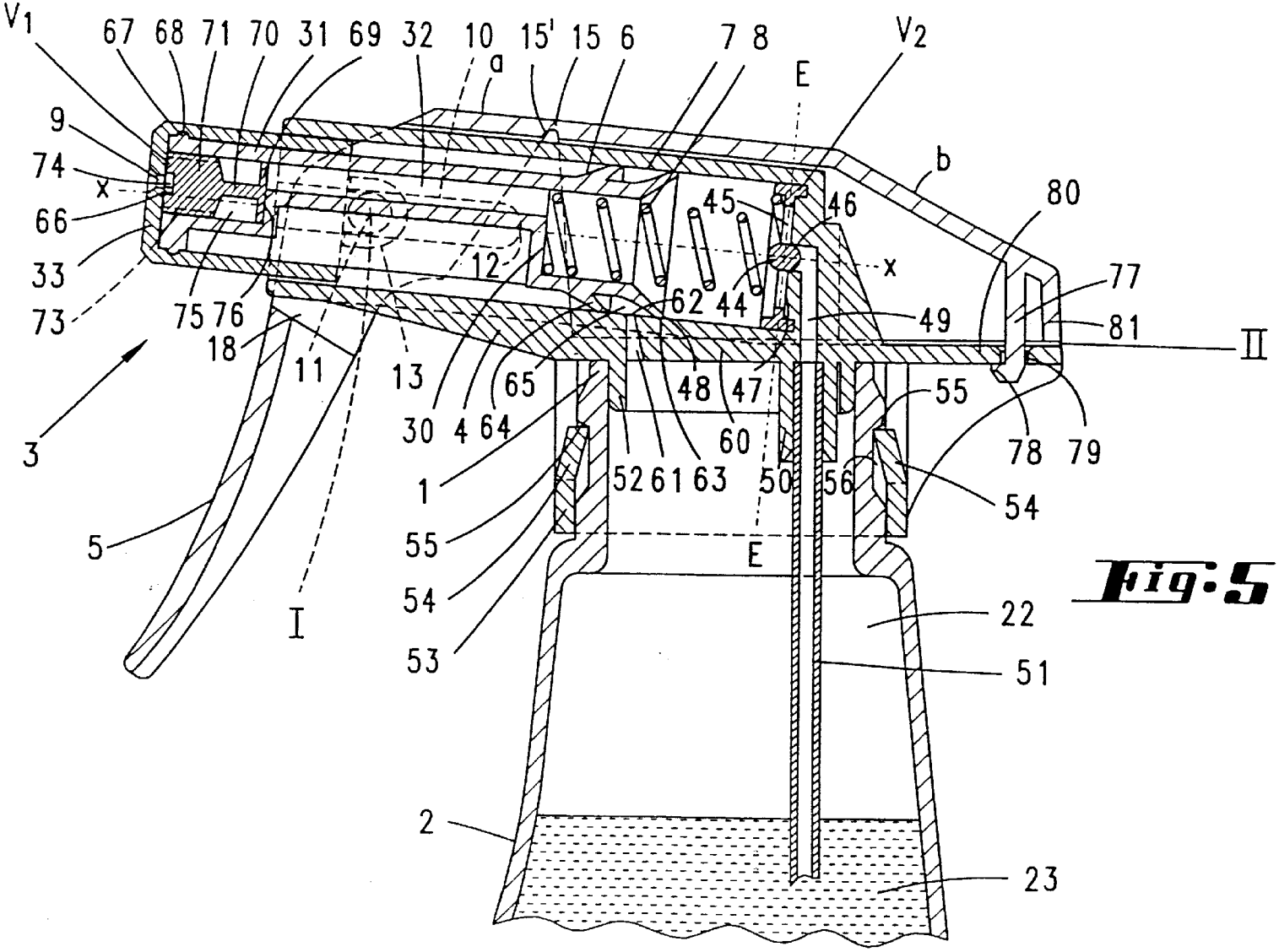
Figures 6, 7, 8:
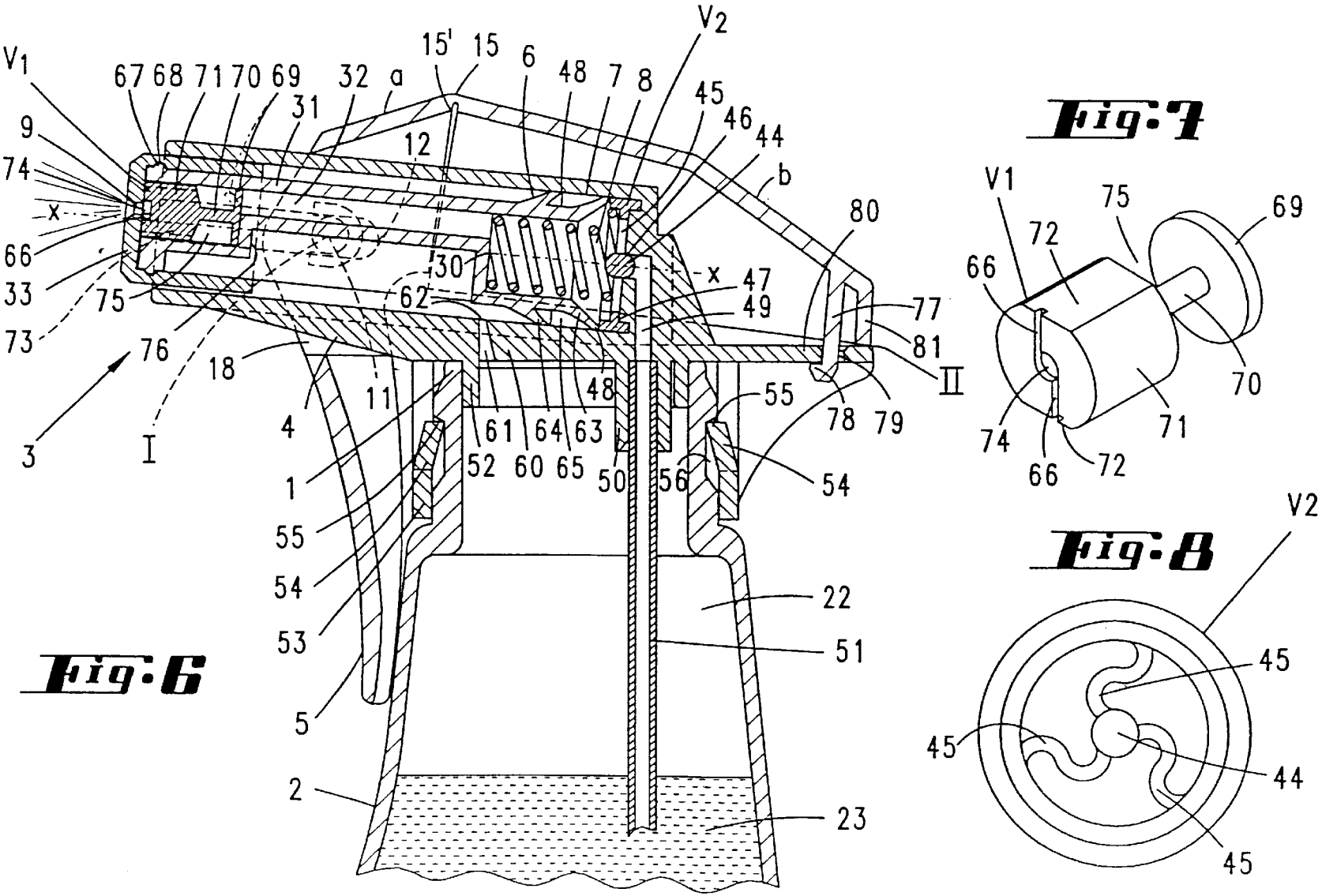

The subject of the invention is described below in more detail by means of an exemplary embodiment illustrated in the drawings, as follows:

FIG. 1 the spray pump of the invention used on a bottle in starting position;

FIG. 2 the same spray pump in operation;

FIG. 3 the pump in starting position in vertical profile with dash-dot lines suggesting the operating position;

FIG. 4 the pump plunger shown individually, in perspective, including the discharge valve and the mouthpiece cap in exploded view;

FIG. 5 a spray pump variant in starting position, in vertical profile;

FIG. 6 the same spray pump, also shown in vertical profile, in operating position;

FIG. 7 a modified discharge valve, shown in perspective, further enlarged with respect to FIG. 6; and FIG. 8 a separate illustration of the inlet valve as seen from top, also further enlarged with respect to FIG. 6.

A spray pump 3 is allocated to the neck 1 of a bottle 2. It is a so-called trigger pump, representing a standing unit in the form of a dispenser for dispensing a powerful spray.

The core of the spray pump 3 is the housing 4, which extends in the manner of a hammer head transverse to the neck 1 which is substantially vertical. The neck 1 is grasped to provide counter-support. A hand lever 5, projecting toward the underside of the housing 4, is located in the range of action of a respective holding hand.

The hand lever 5 swivels about a horizontal first hinge point I of the activation mechanism, i.e., it is pulled against the neck 1. This takes place against a spring loading which, upon release, always returns the hand lever 5 to the starting position as shown in FIG. 3.

The activation position is shown in FIG. 3 with dash-dot lines.

The hand lever 5 is coupled to a pump plunger 6 which moves in a pump chamber 7 that forms a pump cylinder.

The connection between the hand lever 5 and the pump plunger 6 is such that the hand lever 5. In addition to the above-mentioned swiveling movement, shifts linear in the pump chamber together with the pump plunger 6. The respective displacement acts against the expansive power of a pump plunger restoring spring 8 which is located in the pump space. This spring is a threaded pressure spring.

The overriding movement made by the hand lever 5 is realized via a linear guide on the housing side. Longitudinal slits 10 begin at the tube-shaped end of the housing 4. This end faces the mouthpiece opening 9 of the spray pump 3. The longitudinal slits 10 are open toward the front edge of the tube and extend diametrically in longitudinal direction. Their horizontal depth defines the operating stroke in that the axle stubs 11 of the hand lever 5 which create the physical hinge point I move against the interior slit bottom 12.

The axle stub 11 traverse the longitudinal slits 10, which are arranged in pairs, and at the end they engage in respective pockets 13 provided on the two longitudinal sides of the pump plunger 6. This results in driving the pump plunger 6 in the sense that the volume of the pump chamber 7 decreases.

The hand lever 5 is connected with the housing 4 by means of a link chain. In actuality, this is achieved in that two hinge points are allocated to the hand lever 5. The above mentioned hinge point I and a second hinge point, designated with II, which is located on the side of the pump housing 4 opposite to the mouthpiece opening 9.

The two hinge points I, II are connected by means of two bridge sections a, b that buckle with relation to each other. The buckling position is seen in FIGS. 2 and 3. In order to permit the bridge sections a, b to buckle respectively opposite to the housing 4, they are connected via a hinge joint 15 which may be a living hinge. The respective V-notch 15' continues into the cheek-like side walls 16 of the cap-like bridge section b and also into the shield-like root section 17 of the hand lever 5. The coaxially oriented axle stub 11 are attached to the insides of the root section 17.

Consequently, the bridge section b which changes to the substantially vertical side walls 16 is U-shaped.

In contrast, the root section 17, which is attached to the bridge section a and represents a part thereof, is closed toward the grip section of the hand lever 5 allowing the tube-shaped end of the housing 4 to pass freely. This provides a plug-in hole 18 for the purpose of assembly.

The bridge section designated with b supports a locking part 19 which tightly seals a congruently positioned ventilation aperture 20 in the pump starting position.

The ventilation aperture 20 joins a connecting channel 21 which passes through the housing 4 in vertical direction and which is connected with the interior 22 of the bottle 2. When the bridge sections a, b, buckle, as shown in FIG. 2, the locking part 19 on the bridge section b lifts off from the ventilation aperture 20. The partial amount of the fluid substance 23 discharged from the bottle 2 in this position is thus supplemented with air.

As shown in FIG. 3, the hinge jointed bridge sections a, b are resting tightly on the level, horizontal upper side 24 of the housing 4 when the spray pump 3 is in starting position. When the discharge is activated, the bridge sections a, b move roof-like outward away from the upper side 24, preceded by the living hinge point which was created in the area of the hinge joint 15, however, without giving up the lateral support from the latter walls 16 of the bridge section b provided by the guide support on the vertical walls of the pump housing 4, or the respective support from the two roof sections 17.

The free end of the second bridge section b opposite to the mouthpiece opening 9 is provided with a downward directed U-profiled part 25. It also represents an extension of the U-shaped cross section design of the second bridge section b, so that the second bridge section b represents the connector of the U-profiled part which encompasses the housing 4 in a U-shape. One locking peg 26 each is provided on the insides of the U-sections of the U-profiled part 25. The peg 26 engages in a counter-locking contour 27. The respective locking connection between the U-profiled part 25 toward the housing 4 is illustrated particularly clearly in FIG. 3. The counter locking contour 27 is provided with an opening 28 which faces away from the mouthpiece opening 9.

The opening's 28 inside diameter is somewhat smaller than the cross section of the circular peg 26.

At the level of the second hinge point II the U-profiled part of the link chain is horizontally and longitudinally slit up to the U-connector, i.e. the U-sections. The longitudinal slit has reference No. 29 and provides a peripheral material bridge.

The second hinge point II represents a living hinge. The V-notch slopes outward and is clearly diverging. The hinge point II, which is located on the side of the housing 4 opposite to the mouthpiece opening 9, is slightly above the place of the locking connection 26/27.

Beginning at the actual cylindrical plunger section of the pump plunger 6 the latter continues tapering from an eccentric shoulder 30 approximately to the mouthpiece opening 9. This is a type of plunger shaft 31 which adds a connecting channel 32 between the pump chamber 7 and the mouthpiece opening 9. On the side of the mouthpiece, the pump plunger 6 is connected with a mouthpiece cap 33. It is a form-fit connection. The cap 33 is clipped on irreversibly, which is achieved by means of a pot-shaped ring collar 35 attached to the casing of the plunger shaft 31. The ring collar's 35 pot-shaped wall defines the tub-shaped front end 36 of the hollow plunger shaft 31 or of the pump plunger 6, respetively.

A discharge valve V1 in the form of a moldable rubber piece is housed in a space between the front end 36 and the attached mouthpiece cap 33.

The rubber piece has a collar 37 which is plugged onto the tube-shaped front end 36 of the pump plunger 6. In addition, the rubber piece is provided with an integrally attached disk-shaped base part 38 containing axially oriented flow-through cross sections 39. These are connected with supply lines 40 leading to the mouthpiece opening 9 in that the rotating mouthpiece cap 33 on the ring collar 35 of the pump plunger 6 is rotated. The respective open and close positions are defined by a stop. The front edge of the mouthpiece cap 33 keeps the pockets 13 on the side of the mouthpiece opening closed.

The flow-through cross sections 39 and the supply lines 40 are eccentrical with respect to a horizontal rotation axis x—x of the pot-shaped mouthpiece cap 33. The axis is identical to the longitudinal center axis of the pump plunger 6.

The locking valve V1 also acts as a tube valve in that the collar 37 expands with the pressure caused by the fluid.

The windows 41 in the wall of the tube-shaped front end 36 provide access for the media in order to expand the collar 37. The medium rushes into a ring chamber 42 provided between the casing of said tube-shaped front end 36 and the interior wall of the ring collar 35. The ring chamber 42 is closed on the plunger side by means of a transverse wall 43 on the plunger shaft 31.

Closer to the interior 22 of the bottle 2 is the inlet valve V2 which also consists of an elastic material and which is disk-shaped. It is equipped with a centrally located valve locking piece 44 which is supported by crosspieces 45 that leave a flow path between them.

The crosspieces 45 extend substantially radially. They preferably curve in the shape of an S to achieve the opening and closing flexibility for the valve locking piece 44. The valve locking piece's 44 valve seat on the housing side is designated with 46.

The inlet valve V2 is supported by the bottom 47 of the pump chamber 7 opposite to the mouthpiece opening 9 and is held in position by the pump plunger restoring spring 8 in that the winding at its end pushes the disk-shaped body of the inlet valve V2 against the bottom 47.

The opposite end of the pump plunger restoring spring 8 acts as a load against the cross section-reducing shoulder 30 in the interior of the hollow pump plunger 6.

As shown in FIG. 3, the end of the pump plunger 6 opposite to the shoulder 30 is rotation symmetrically formed into a ring lip. It forms an edge 48 while the cross section of the remaining cylinder wall of the pump plunger 6 recedes. The edge's 48 larger cross section opening trails on the wall of the pump chamber 7.

Following a short horizontal channel section, the valve seat 46 changes to a vertical channel section 49 which continues in a connection piece 50 where an ascending pipe 51 is clamped on. The ascending pipe 51 nearly reaches the bottom of the bottle 2.

For a tight fit between the spray pump 3 and the bottle, the housing 4 forms a ring wall 52 at its underside.

The ring wall 52 is pushed into the opening at the neck 1 to provide a tight seal.

In order to attach the spray pump 3, the housing 4 is plugged onto the neck 1 of the bottle 2 by means of a plug-in/clip connection. This is achieved with a plug-in collar 53 which is equipped with locking fingers 54 located on diametrically opposed sides. By means of an irreversible snap connection, the locking fingers 54 engage in a blocking flank 55 on the neck 1. This is provided at the underside of a collar-like projection and is overrun in forward motion by the locking fingers 54 acting like barbs.

The blocking flank 55 represents the upper end of a cavity 56 on the casing of the neck 1. The width of this cavity 56 in circumferential direction of the neck 1 corresponds to the width of the locking fingers 54 which also achieves an advantageous rotation lock. This results in a defined orientation for the hammer head-like spray pump 3 with respect to the bottle body which may be designed flat in the same direction.

With respect to the supply lines 40, it should be noted that they end tangentially in a collecting chamber which creates a swirl chamber 57. This causes a rotation effect and thus generates a stable stream.

The discharge valve V1 is mounted non-rotating in the ring chamber by means of an eccentric projection 58 which projects into a matching recess (not shown) in the ring collar 35.

The variant of the spray pump 3 illustrated in FIGS. 5 through 8 is designed according to the same principle. The reference Nos. are used accordingly. Any extensive applicable specifications are not repeated.

The modified air compensation system is discussed first. With respect to activation, it has been shifted to the range of action of the pump plunger 6. The latter represents a productive functional part of this system. The pump plunger 6 acts as a slide.

In actuality, this is embodied in that the housing wall 60 is equipped with a ventilation aperture 61 on a plane of projection on the bottle neck 1. The aperture 61 provides the shortest possible flow connection between the pump chamber 7 and the interior 22 of the bottle 2. The ventilation aperture 61 extends on the underside of the housing 4 as defined by the ring wall 52. The latter is pushed into the opening on the bottle neck 1 to seal.

In pump starting position (also see FIG. 5), the ventilation aperture, the mouth 62, on the pump chamber side is closed by the casing of the pump plunger 7. As shown, said mouth 62 extends directly behind the edge 48 of the pump plunger 7 which edge acts as a piston ring 63.

A second piston ring, designated with 64, is provided axially spaced apart and offset in the direction of the mouthpiece opening 9 of the spray pump 3. Both piston rings 63, 64 are pointed in the form of a lip in the direction of their free ends. With respect to the discharge direction, the piston rings 63, 64 are receding and have a pitch of approx. 30° with reference to the axis x—x.

In the pump starting position (also see FIG. 15 [sic]) the mouth 62 is approximately in the center between the two piston rings 63, 64 which are axially spaced apart and which create a ring space 65. Any excess pressure, which may be caused by heat, is transferred to the ring chamber 65. This causes the side of the second piston ring 64 on the ring space side to be pressed even more tightly against the cylinder wall of the pump chamber 7, thereby increasing the sealing effect. If the bottle should fall, no fluid is able to flow out.

In pump plunger operating position (also see FIG. 6) the interior 22 is connected with the atmosphere via the ventilation aperture 61. On the discharge side, i.e., behind the second piston ring 64, a path is open via an intended leakage between the housing 4 and the mouthpiece 33. The discharged liquid substance 23 is compensated by the inflowing air.

When the hand lever 5 is released, the pump plunger 6 returns to its starting position, illustrated in FIG. 5, as a result of the spring loading.

According to the spray pump 3 variant, the inlet valve V2 is designed in such a way that, regardless of which of its surfaces meets the bottom 47 of the pump chamber 7, it is always properly placed. This is due to the mirror symmetrical design. Again, it is based on a disk-shaped inlet valve body made of a readjustable material with a centrally located valve locking piece 44. However, the centrally located locking piece 44, which again is attached to crosspieces 45, is now designed end identical, i.e., a barrel-shaped locking piece is equipped axially on both sides or both ends, respectively, with convex hemispherical ends.

The end on the allocation side acts together with the valve seat 46 on the bottom 47. The center axis of the barrel-shaped locking piece 4 {sic] coincides with the rotational axis x—x of the pot-shaped mouthpiece cap 33. In addition, this axis is identical to the longitudinal center axis of the pump plunger 6.

A peripheral collar also projects rotation symmetrically on both sides, forming or delimiting, on one side, a spring hanger together with a crosspiece for the winding on the end of the pump plunger restoring spring 8, and, on the other side, together with its other crosspiece, it is seated in a ring groove with corresponding contour in the bottom 47. As illustrated in FIG. 8, the crosspieces 45 are S-shaped on said plane, thereby providing sufficient spring reserves for the valve function. The crosspiece ring has a virtual T-section with the T-connector being centrally aligned with the valve locking piece 44. In FIG. 5, the disk center plane is designated with E—E.

With respect to further developing the discharge valve V1, the pot-shaped design has been modified to a solid body. Reference is made to FIGS. 5 and 7.

Again, the discharge valve V1 is allocated to the mouthpiece cap 33 in such a way that the supply channels 66, located on the fore-part of the discharge valve V1, can be closed with relation to the decentrally located mouthpiece opening 9. The rotation guide is an annular ring 67 attached to the plunger shaft 31 and engaging rotating in a corresponding ring groove in the mouthpiece cap 33.

It also represents an irreversible plug-in connection for both parts.

The components of the discharge valve V1, which is a moldable rubber piece, at least in part, are a valve disk 69 and a stem 70 coaxially attached thereto and changing to a stopper part 71. The design is rotation symmetrical while the stopper part 71, which is basically cylindrical, is flattened in two places over the entire length. The flattered parts are designated with 72. They represent longitudinal channels 73 opposite to the cylindrical interior wall of the mouthpiece cap 33 which encompasses the casing of the stopper part 71. The longitudinal channels 73 have the cross section of the segments of a circle. Said flattened parts 72 are diametrically opposed and are vertically oriented in FIG. 5.

Running angled in the direction of flow, the flattened parts 72 or the resulting longitudinal channels 73, respectively join the supply channels 66 located on the front side of the stopper part 71. The supply channels 66 are tangent and run into a circular swirl chamber 74. The tangent inflow is also diametrically opposed. The supply channels 66 appearing in the form of troughs on the front surface in FIG. 7 are covered by the interior surface of the bottom of the mouthpiece cap 33.

The swirl chamber 74 is eccentric with respect to the rotational axis x—x of the mouthpiece cap 33. The same applies to the mouthpiece opening 9 which forms the spray nozzle of the spray pump 3. The mouthpiece opening 9 is relocated in that the mouthpiece cap 33 is rotated such that the mouthpiece opening 9 leaves the supply area of the swirl chamber 74 and thus is sealed and located in front of a part of the discharge valve's V1 front surface which does not contain any channels and which has a locking effect.

The supporting crosspiece 81 runs substantially parallel to the shaft of the hook 77. The shaft even has a certain spring function (leaf spiral spring) and may be somewhat lengthened, which is demonstrated by FIG. 7.

The supporting crosspiece 81 is a component of the end of the respective buckling bridge section b.

All disclosed characteristics represent an essential part of the invention. The disclosure of the application also includes the complete disclosed content of the pertaining/attached priority documents (copy of the pre-application) which also serves the purpose of incorporating characteristics of these documents in the claims of this application.

The valve function of the valve disk 69 is such that, in the direction of flow, the upper part as seen in the drawings is pushed over in the manner of a valve flap (see dash-dot representation in FIG. 6). The connecting channel 32 provides a stable support shoulder 76, oriented vertically to the axis x—x, in that it creates a valve storage space 75 which has a clearly larger diameter than the virtually segment-shaped connecting channel 32. The discharge valve V1 is simply inserted through the open end of the valve storage space 75. The mouthpiece cap 33 is then clipped on to provide a cover.

The stem 70 on the discharge valve V1 is axially oriented and is positioned in the range of the support shoulder 76.

As to the other type of bearing in the area of the hinge point II, a vertically oriented lock is provided between the buckling bridge (sections a, b) and the housing 4. The locking connection on the housing side of the second buckling bridge section b is achieved by means of a hook 77 which is attached to the above-mentioned bridge section b. The actual hook has reference No. 78. The hook 78 passes through a hole 79 which is provided in a housing console 80. The latter is attached freely projecting to the end of the housing 4 opposite to the mouthpiece opening 9. The anchoring hold is clearly illustrated in FIGS. 5 and 6. These also show that the hook 77 is adjacent to an outer supporting crosspiece 81 whose front surface, which is directed toward the upper side of the housing console 80, creates the hinge point II in that it is thrust against the console 80. The respective contact point is close to but behind the hole 79, i.e. offset in outward direction.

What is claimed is:

1. A pump dispenser comprising:

a. a housing part having a front end and a rear end and a downward portion for mounting on a container;

b. a pump cylinder fixedly disposed on the housing part and having an open end facing the front end of the housing part and formed with a slot along one side of the open end;

c. a piston/nozzle assembly reciprocable in the open end of the cylinder;

d. a trigger/cover assembly comprising a cover portion having a forward and a rearward end, the rearward end being hingedly connected to the rear end of the housing part and a generally L-shaped trigger portion having an upper end, an intermediate portion and a lower end, the upper end being hingedly connected by a living hinge to the forward end of the cover portion, the intermediate portion being pivotally connected to the piston/nozzle assembly through the slot, the lower end of the trigger portion serving as a trigger lever, the cover portion and the upper end of the trigger portion defining a straight line through the living hinge when the piston/nozzle assembly is forward in the cylinder.

2. A pump dispenser comprising:

a. a housing part having a front end and a rear end and a downward portion for mounting on a container;

b. a pump cylinder fixedly disposed on the housing part and having an open end facing the front end of the housing part;

c. a piston/nozzle assembly reciprocable in the open end of the cylinder;

d. a hinge support element extending upward from the housing part and having a hinge element at a forward end above the cylinder, e. a trigger element having its upper end pivoted to the hinge element, an intermediate portion pivotally attached to the piston/nozzle assembly and a lower portion serving as a trigger lever, the improvement wherein the hinge support element is pivoted to the housing part at its rear end, and the cylinder has slots on its opposite sides and the pivotal attachment of the trigger element rides in the slots.

3. A pump dispenser comprising:

a. a pump body including a horizontal cylinder having an open end and longitudinal guide slot on a side of the cylinder from the open end, b. a piston in the cylinder, c. a trigger assembly pivotally secured to the body at a first point and including a lever and a tension element joined by a living hinge, parts of the tension element and the liver defining a flat horizontal plane through the living hinge when the piston is in an extended position in the cylinder, d. a transverse element extending between the trigger assembly and the piston at a second point on the opposite side of the living hinge from the first point and sliding in the longitudinal guide slot, whereby moving the lever in one direction draws the first and second points toward each other to move the piston as the living hinge flexes.

* * * * *